United States Patent [19]

Kramer Da Luz

[11] 4,409,917

[45] Oct. 18, 1983

[54] ROTATING PONTOON

[76] Inventor: Olavo Kramer Da Luz, Raa Gen. Joao Manbel- 604/Apto 14, 90.000 Porto Alegre Rio Grande Do Sul, Brazil

[21] Appl. No.: 376,609

[22] Filed: May 10, 1982

Related U.S. Application Data

[63] Continuation of Ser. No. 170,672, May 2, 1979, abandoned.

[30] Foreign Application Priority Data

Sep. 2, 1979 [BR] Brazil ..... 7705898[U]

[51] Int. Cl.[3] ..... B63B 35/30

[52] U.S. Cl. ..... 114/38; 114/73; 114/45; 414/137

[58] Field of Search ..... 114/27, 32, 38, 45, 114/51, 73, 125; 414/137, 138, 139, 140, 143, 359

[56] References Cited

U.S. PATENT DOCUMENTS 185,596 12/1876 Van Dusen ..... 414/359
713,454 11/1902 Knapp ..... 114/73
1,486,257 3/1924 Muller ..... 114/45
1,823,172 9/1931 Schon ..... 414/137
3,845,634 11/1974 Rosenberg et al. ..... 114/51
4,043,467 8/1977 Hand, Jr. ..... 414/359
4,058,203 11/1977 Briggs ..... 414/140

*Primary Examiner*—Trygve M. Blix
*Assistant Examiner*—Jesus D. Sotelo
*Attorney, Agent, or Firm*—Emory L. Groff, Jr.

[57] ABSTRACT

A rotatable pontoon includes a floating cylinder provided with watertight compartments and having a hollow interior for receiving one or more vessels adapted to be overturned by rotation of the pontoon. Rotation is achieved by either external power or by successively displacing water from one compartment to another. An external platform attached to the pontoon maintains a normal upright position during rotation of the pontoon and serves to contain accessory equipment. Alternatively, this equipment is attached to a belt surrounding the pontoon and fastened to stationary flotation tanks. Floating roofs are included to allow operation during rainy days and for removing load fractions remaining after a vessel is overturned, pushing panels and helicoidal hatch-feeders are provided.

7 Claims, 30 Drawing Figures

SECTION A-A

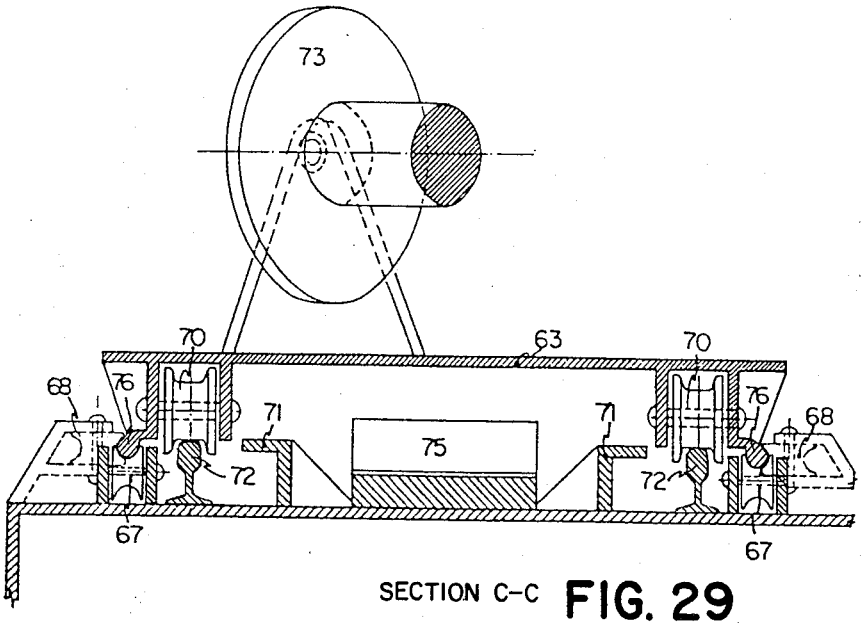
SECTION C-C FIG. 29
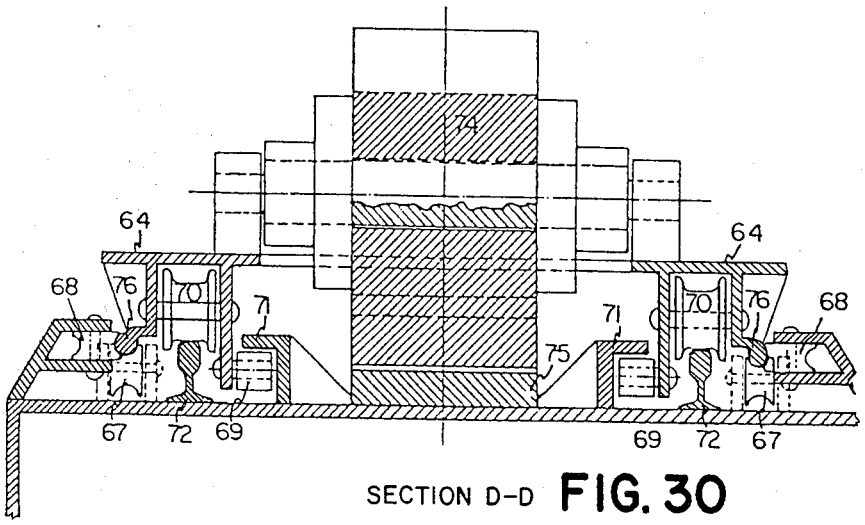
SECTION D-D FIG. 30

ROTATING PONTOON

This is a continuation of application Ser. No. 170,672, filed May 2, 1979 now abandoned.

TECHNICAL FIELD

In recent years, a remarkable advancement concerning port cargo handling systems has been observed all around the world.

The general cargo (boxes, burdens, sacks, etc), which predominated till the 50's has been gradually replaced by containers, dry and liquid bulk cargoes.

Nowadays, in modern ports, ore and agricultural products are wholly loaded in bulk.

On the other hand, we, in Brazil, have been giving an increasing importance to the utilization of fluvial transport in substitution to the overload one, mainly when concerning the conveyance of ore and agricultural products. It happens not only because it is the cheapest way of transport, but also because it is one of the most adequate systems to save money for the country, to provide competitive conditions to our products in the external market, and to face the oil worldwide crisis.

Yet, port time periods required for loading and unloading must be made as short as possible so that this way of transport will achieve the desired development.

Swiftness in this late operation is also an essential requirement for the satisfactory performance of our port system.

Therefore, our naval industry, the fluvial navigation shipowners and the port and maritime official boards are, by all means, searching effective manners of speeding-up that operation.

BACKGROUND ART

Ports which operate mostly in unloading or transhipment of agricultural exporting products arriving in fluvial vessels, like the port of Rio Grande (State of Rio Grande, Brazil), are now using specific unloading places for this nature of navigation and cargo (dry bulk), equipped with shore discharging facilities and mechanized transportation of materials to store.

However, in these ports, the equipment which has shown more efficiency to solve the problem is the transhipment pontoon. It executes the transference of load from the holds of fluvial vessels straight to the ocean going ship holds.

The transhipment equipment is installed on the pontoon like a conventional ship hull.

Basically, these pontoons have different processes of cargo handling. They can be abbreviated as the three following processes or their combinations: pneumatic; mechanical-continual (bucket unloaders, chain conveyors, endless screw, belt conveyors); mechanical-intermittent (crane with grab gear).

All these unloading methods are still effected by some slowness, caused mainly by the equipment speed limitation and by the need of hatch-feeding in the existing load of the fluvial vessel.

Acceleration of the unloading speed of fluvial vessles in ports, and the performance of port facilities concerning rapidity and simplicity in loading ships, are problems that have also been worrying the inventor for quite a long time.

After elaborating many ideas and attempts in order to adapt the conventional methods and equipment to achieve that intent, the Author conceived a kind of rotating pontoon which is disclosed in this application.

DISCLOSURE OF INVENTION

The fundamental principle of the invention is the conception of a long tubular shaped pontoon, open at least at one of its ends. This structure can turn about its longitudinal axis at any given angle.

For this to happen, it is a basic condition that the transverse section of this pontoon have a circular or closed polygonal shape or both, in the periphery of which watertight compartments can be arranged in such a way that they can support the platform floating, no matter its position, considering its own weight as well as the load it should contain.

Once assured the floating circumstances of the pontoon, its internal structure admits many different arrangements according to the desired purpose.

The pontoon size is also subordinated to this purpose and to the depth of water in the place it should operate.

Equally, there are many forms of producing rotation, some of which will be described later without considerations about their applications and limitations, for they are enumerated in this text.

The described characteristics give a remarkable series of applications to the invention as, for instance, in the construction of dry-bulk-cargo transhipment pontoon, floating docks used in shipbuilding or in ship repairing, floating stores, etc.

BRIEF DESCRIPTION OF DRAWINGS

The attached 14 sheets of drawings contain 30 Figures.

FIGS. 25, 26, 27, 28, 29 and 30 illustrate the system of winches, fenders and braker conceived by the Author.

BEST MODE OF CARRYING OUT THE INVENTION

1. SELF-ROTATING PONTOON WORKING BY LIQUID TRANSFERENCE FROM ONE RESERVOIR TO ANOTHER

Suppose the floating tube described above as a vessel with its walls formed by watertight compartments, similarly to the ship side and with doublebottoms properly divided longitudinally, being able to stand a rotating movement on its longitudinal axis, achieved by means of the liquid displacement in ballast tanks distributed in the periphery.

For a better description of this rotation, the floating tube is initially represented by a transverse section (FIGS. 1 & 2) which shows two watertight compartments forming juxtaposed and concentrical round shaped crowns which form its wall.

Surely there are innumerable convenient arrangements and positions to these tanks that would reach the same result, but this one was chosen in order to simplify the principle exposition.

On that account, in the initial stage of the exposition, the pontoon internal structure is neglected; it, as previously seen, can have many different arrangements in accordance with the desired utilization.

The conception is based on the floating body properties, as here described, to turn about its longitudinal axis at any desired angle, by transferring liquid existing in ballast tanks of one side to the similar tanks situated on the opposite side, in a previously arranged sequence.

Figure 1:
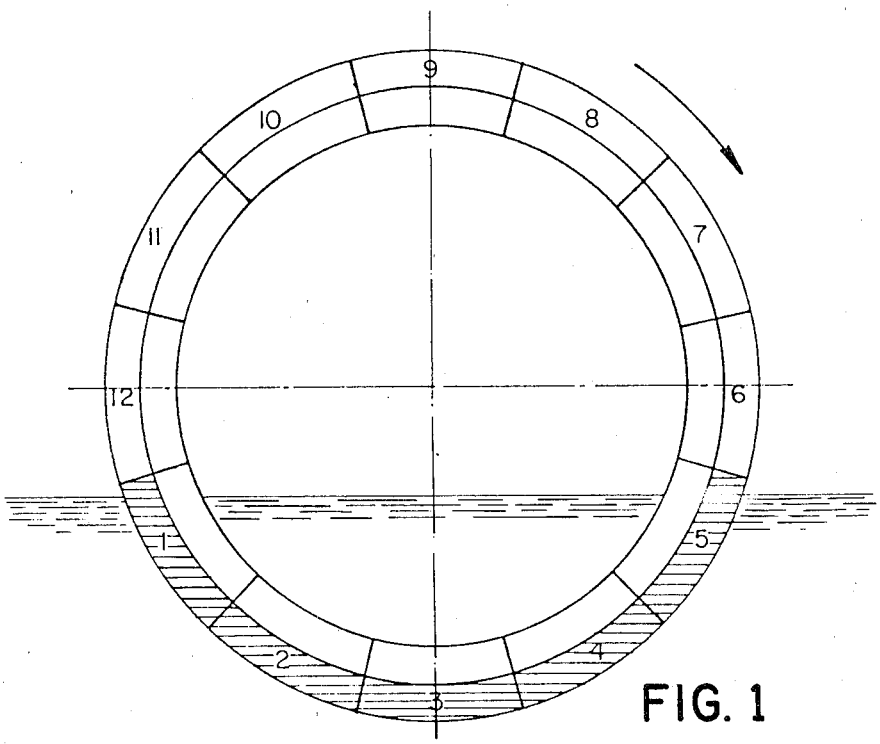
FIGS. 1 and 2 show schematic cross sections of the pontoon flooded only with the tanks located below waterline.
Figure 2:
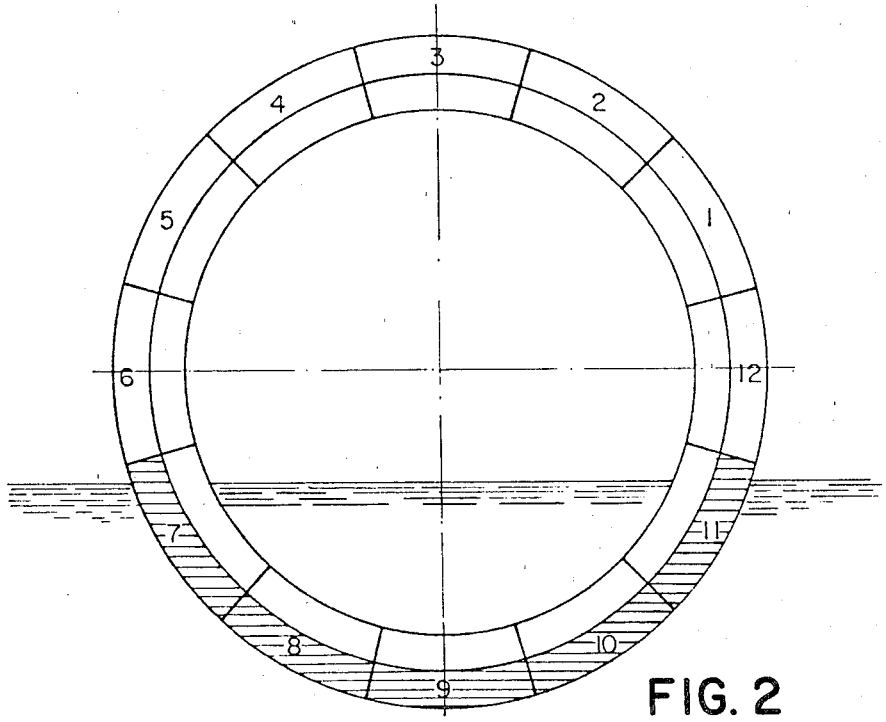
Figure 3:
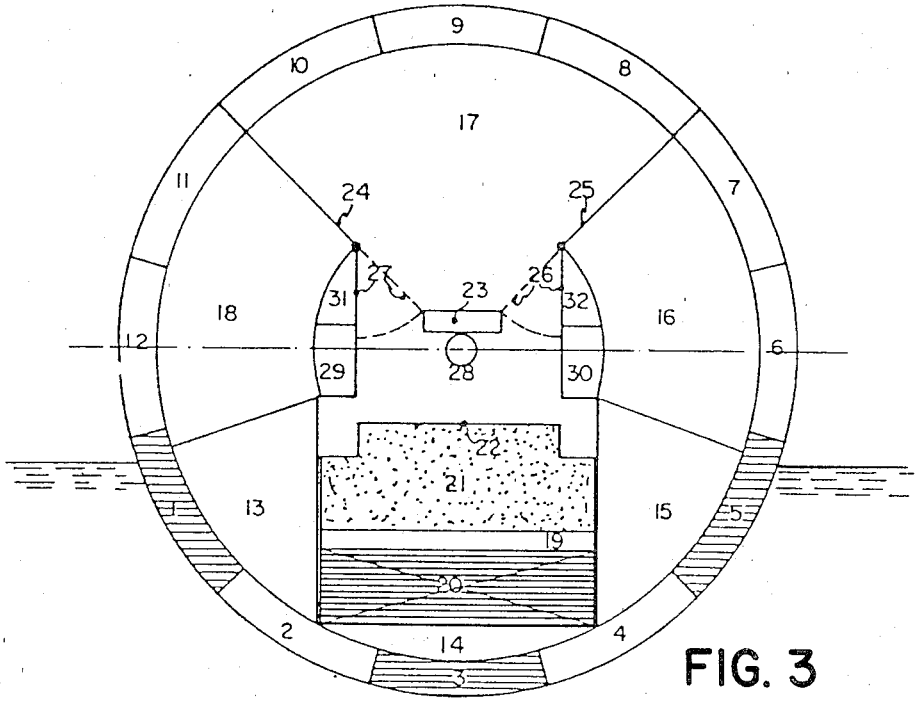
FIGS. 3 and 4 are similar sections showing also the fitting device.
Figure 4:
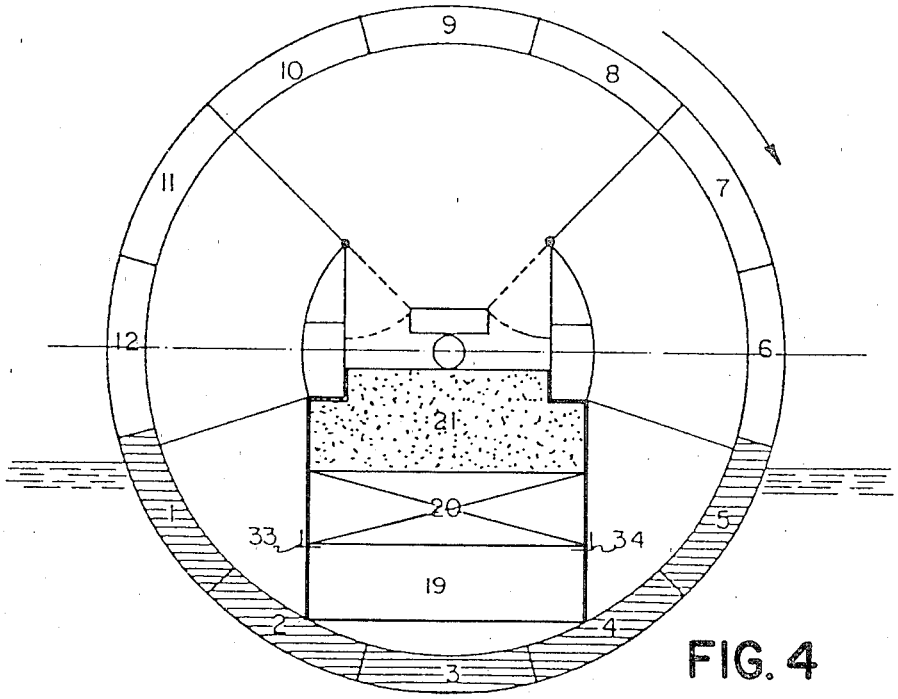

Considering, for instance, that initially the pontoon shown in FIG. 1 is flooded only with the tanks located below the waterline (1-5), and starts to transfer the water (indicated in horizontal hatched area) sequentially from tank Number 1 to Number 6, from Number 2 to Number 7, from Number 3 to Number 8 and so forth, we can obtain a total rotation (360°) of the floating tube)

This property allows to conclude that in any pontoon, in which the transverse section has the shape shown in the 3rd item, it is possible to obtain the same effect (rotation) through a simple water transference from one ballast tank to another, in a proper sequence, since these tanks have a convenient dimension in relation to the resultant formed by the structure weight moment, added to its cargo moment, related to the rotation center in each rotation instant.

2. SELF-ROTATING PORTION WORKING BY LIQUID DISPLACEMENT INSIDE RING SHAPED RESERVOIRS

A hollow floating tube is represented by FIGS. 20 to 24, taking into consideration only its double walls but not its internal structure arrangement.

These walls are formed by continuous rings totally hollow (Flotation Tanks—57) intercalated by rings that have only one division consisting of watertight bulkheads (59) which cannot be transposed by compressed air (ballast tanks —58).

The ballast tanks are interconnected by means of tubes 60, situated adjacently and in each side of the bulkhead, allowing free passage of air.

They also have air outlets (61) provided with valves that can be remote controlled.

Figure 20:
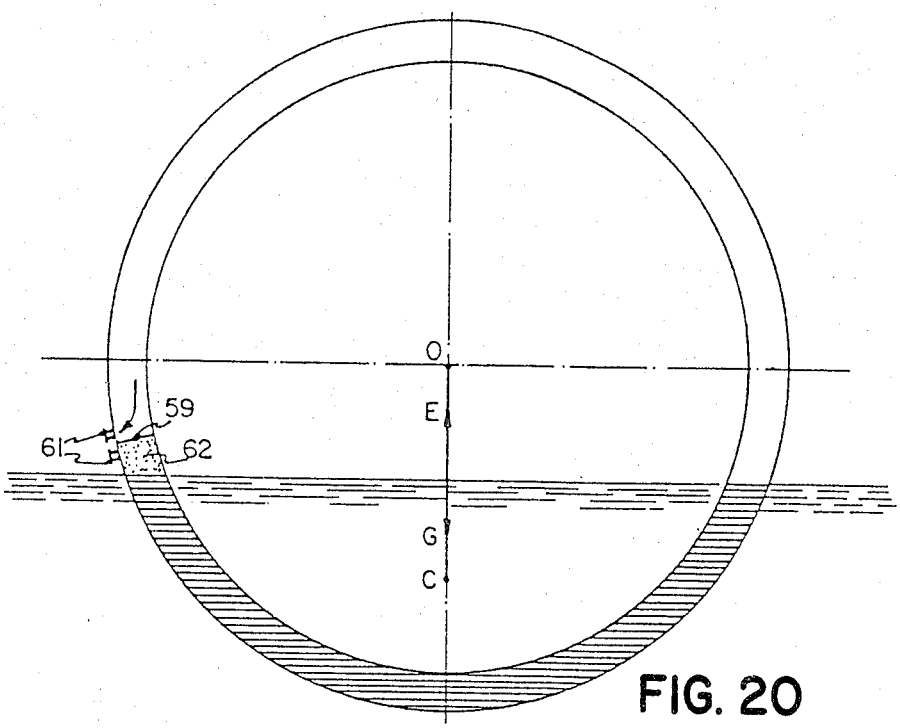
FIGS. 20 to 24 represent the hollow floating tube of the pontoon shown in transverse section (FIGS. 20 and 21) and illustrating how it rotates by means of the continuous ring shaped reservoirs (FIGS. 22, 23 and 24)
Figure 21:
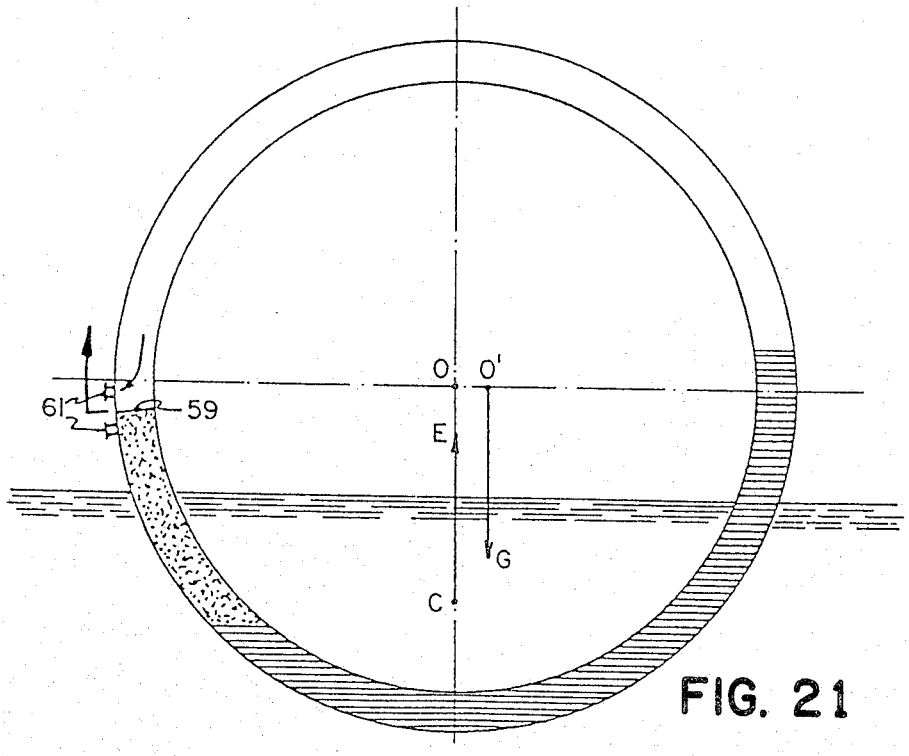
Figure 23:
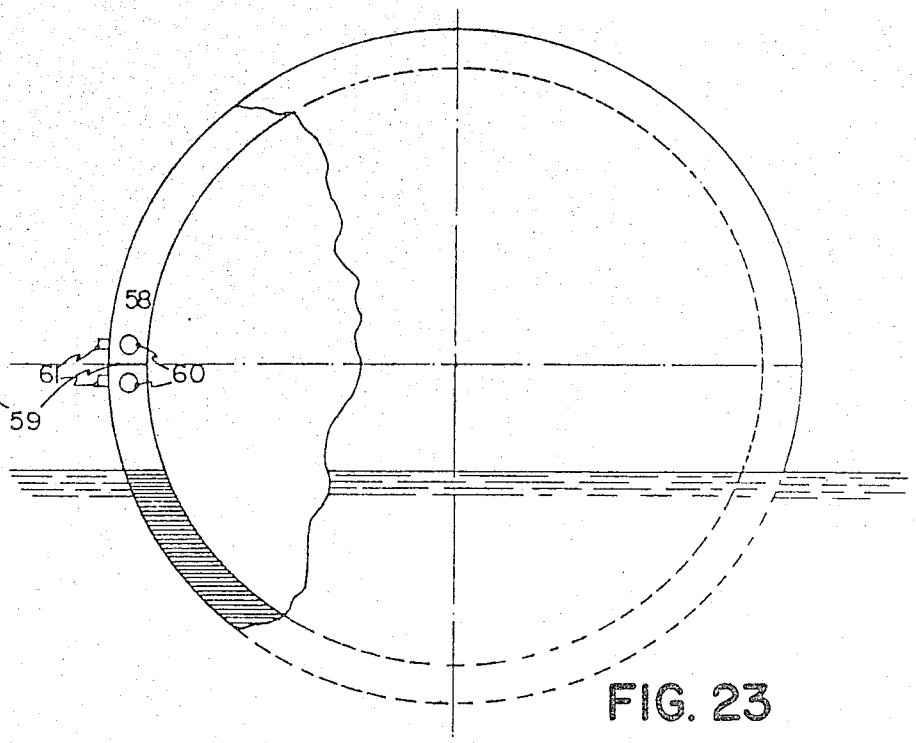
Figure 24:
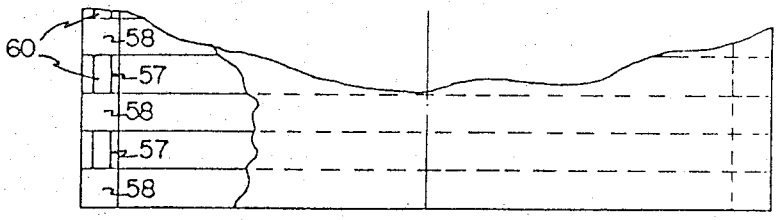
Figure 22:
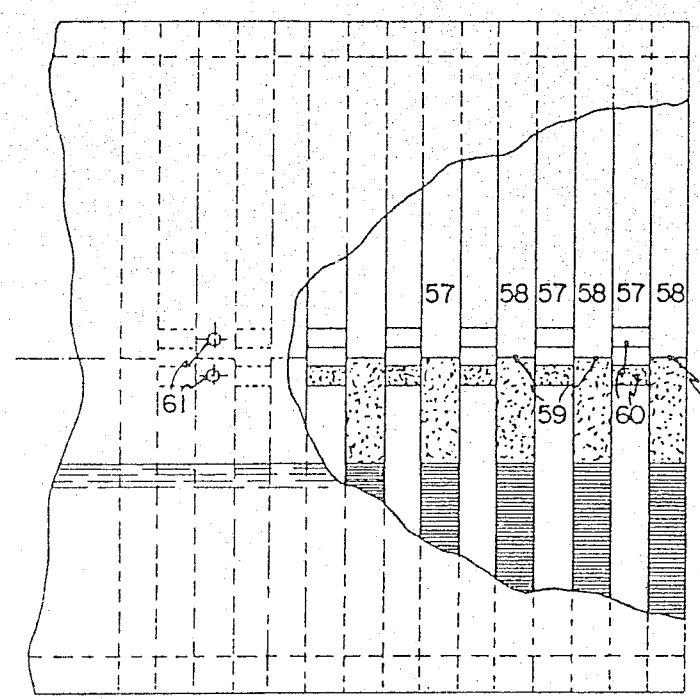
Figure 25:
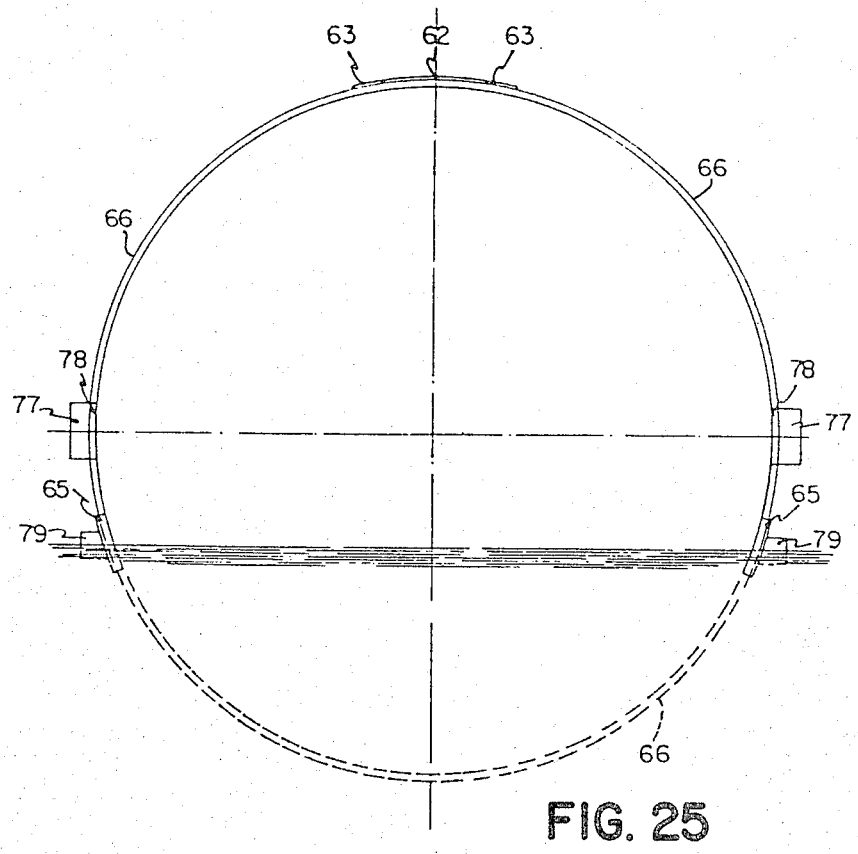
Figure 26:
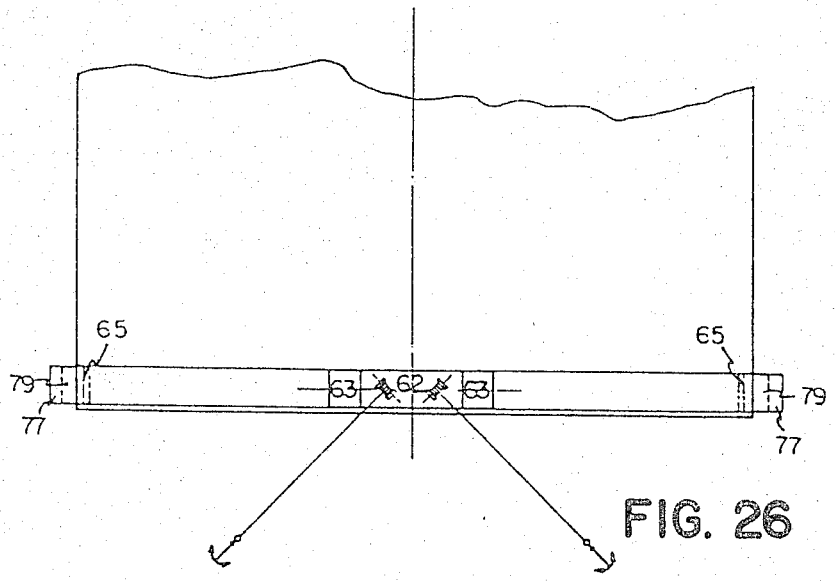
Figure 27:
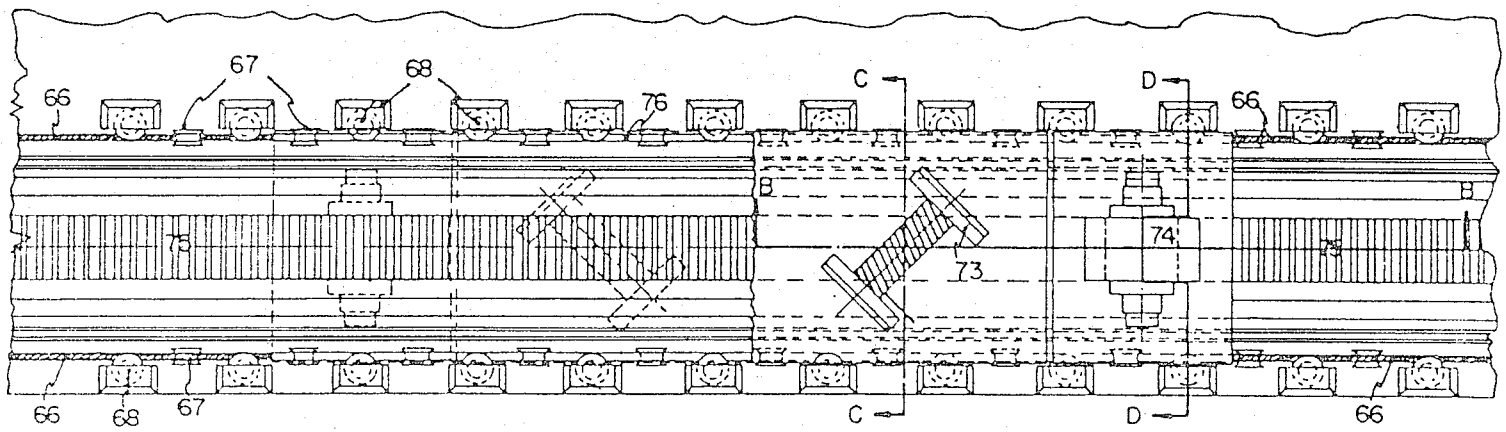
Figure 28:
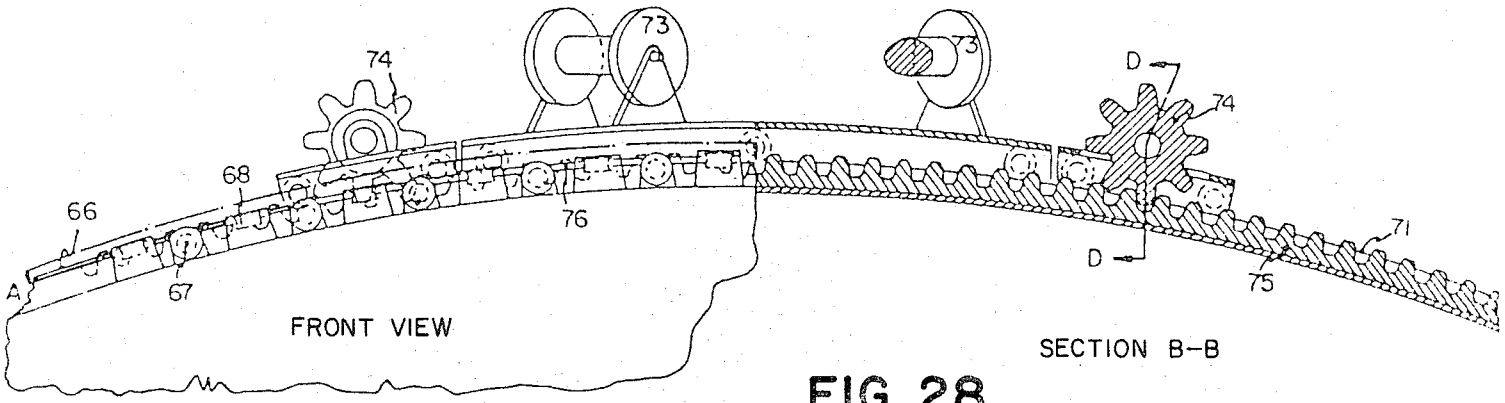

FIGS. 20 and 21 represent the transverse section of the floating tube cutting a ballast tank (58).

In both cases it is assumed that inferior air outlet valves are closed and the superior ones open.

If compressed air (stippled area) is injected inside the chamber (62), the water level (horizontal lined area), existing inside its inferior section, will be driven to the opposite side (FIG. 21), causing a displacement of the center of gravity, arising for this reason a moment (a pair of equal and opposite forces) able to surpass the inertia of the vessel and produce its rotation.

At this stage, the moving of the bulkhead (59) and consequently of the whole pontoon starts to occur in clockwise sense, driven by the compressed air (21).

In fact, regarding to FIG. 20:

Point O is the vessel (or tube) center of gravity or the application point of the resultant (formed by the combination of its own weight and load vectors);

Force G is the resultant mentioned above;

Point 'C' is the buoyancy or volume center, being the center of gravity of water volume displaced by the vessel, as well as the application point of force 'E';

Force 'E' of buoyancy is the resultant of all vertical components of water pressure actuating on the vessel immersed surface.

It is well known, as floating and equilibrium requirements, that vertical opposite forces must be equal and acting at the same diametral plane of the vessel, that is, at the vertical plane containing the vessel's longitudinal axle.

The water interchanging inside the ballast tanks from one side to another (FIG. 21), achieved by means of compressed air, dislocates momentarily the center of gravity of the vessel from 'O' to 'O', creating a pair of equal and opposite forces ('E' -nd 'G') which causes the apparatus rotation.

This theoretical presentation is partly related to the above item and to the foregoing considerations.

For this reason, it is possible to perform a rotation of the pontoon only by displacing, using compressed air and the liquid inside its ballast tanks, or in other words, by displacing the pontoon taking the liquid as reference.

3. PONTOON ROTATION BY MEANS OF EXTERNAL POWER

It is possible to produce rotation in the pontoon described in item No. 3 without the use of its inside liquid.

To achieve this purpose, the Author conceived a system of winches, fenders and brakes, as shown in FIGS. 25, 26, 27, 28, 29 and 30. The winches (73), fenders (77) and pinion-brakes (74) are installed on trolleys 64 which are attached to the hull by means of a belt formed of tense wire ropes or chains (66). These ropes (or chains) are positioned on the correct place with the aid of fixed sheaves (67 & 68), along its contour.

The trolley platform 63 has a circular shape to suit the pontoon external surface. The trolleys are sustained by sheaves (67 & 68) and connected to ropes (or chains) forming the belt. They consist in a part of this belt, running on flanged wheels (69 & 70) guided by rails (71 & 72).

Close to the trolley platform (63) containing the winches (73), are placed the trolleys (64) equipped with the pinion-brake device (74), geared by its turn to the crown-shaped rack (75). Like the rails, the rack is arranged around the pontoon contour, as shown in the figures.

The pinion movement on the rack is produced hydraulically, by motor, or by any other energy source, being stopped by means of any kind of remote controlled conventional brakes.

On trolleys (65) similar to those of the winches (73), and as those attached to the belt, are placed flotation tanks (79), designed to keep the belt steady during the pontoon rotation by means of its buoyancy. It must as well keep in proper position the accessories placed on the belt, and absorb the stresses exerted on it, including those producing the pontoon rotation and braking.

In like manner fenders (77) of any conventional type are placed in proper position or trolleys (78) attached to the belt.

The pontoon outline size alterations due to the natural and momentary deformation of its hull are not important in the present subject, but by precaution it is advisable to provide the belt ropes (or chains) 66 with an elastic or spring portion adequate to take up the strains.

The utilization of the equipment disposed on the belt system here described, requires for its inspection and maintenance a hung ladder or similar, to be attached to the pontoon contouring the hull beside the belt, or fixed to it.

4. TRANSSHIPMENT OF DRY BULK CARGO THROUGH THE ROTATING PONTOON

As previously seen, there are uncountable applications and structural arrangements which allow the invented craft self-rotation, provided that its basic characteristics are maintained, even for a specific utilization.

Among these, was chosen for a better description its utilization as dry bulk transshipment pontoon. In this case, load can be transferred from the holds of any type of fluvial vessels to the storage compartments internally located in the proposed equipment, and, then, to an external hopper from which it can be lifted to an ocean-going ship deck, or conveyed to a land based storehouse.

As an example of this apparatus, it was conceived a pontoon transverse section shown in FIGS. 3-6, where are indicated:

1 to 12—ballast tanks
13 to 15—flotation tanks
16 to 18—watertight compartments which can be used as storage
19—canal
20—vertically displaceable watertight lifting device
21—vessel to be unloaded
22—vessel hatch
23—mechanical conveyor
24/25—retractable flood gates
26/27—hinged shutting panels
28—discharging chute
29—inspection gallery
31/32—Galleries of hydraulic and electric networks
33/34—Vertical hydraulical jack.

5. TRANSSHIPMENT PONTOON OPERATION

At the beginning of the operation only the ballast tanks 1, 3 and 5 and the lifting device which remains on the bottom of canal 19, are flooded.

The vessel, towed by winches and with its hatches opened, enters this canal. The canal is equipped with photoelectric cells or guiding rollers, placed on its walls in order to avoid damages.

Next, the vessel is perfectly aligned in relation to the pontoon longitudinal axis by means of vertically displaceable horizontal hydraulic jacks, placed in proper positions along the canal walls.

Thereupon, the water existing inside the lifting device (20) is transferred to tanks 2 & 4 through flexible hoses, and then the watertight lifting device (20) raises the vessel so that its deck engages the inspection gallery (29/30) underneath side, where the contact surfaces are provided with rubber to avoid water infiltration. The shape and size of this surface should be established according to the characteristics of the vessel(s) to be discharged.

By means of vertically displaceable hydraulic jacks (33 & 34), placed on canal 19 walls, the vessel and the lifting device are held together in this position against the pontoon structure.

Panels 26 & 27 are placed in vertical position and fixed to the walls of galleries 31 & 32.

The pontoon rotation is started through a progressive water transference from tanks of one border to the opposite, as for example, in the following process: from 1 to 6; 2 to 7; 3 to 8; 4 to 9; 5 to 10; and 6 to 11.

Water transference from one tank or compartment to another can be achieved by means of compressed air, injected through a properly sized rigid pipeline, provided with conveniently placed remote controlled valves and registers.

Figure 5:
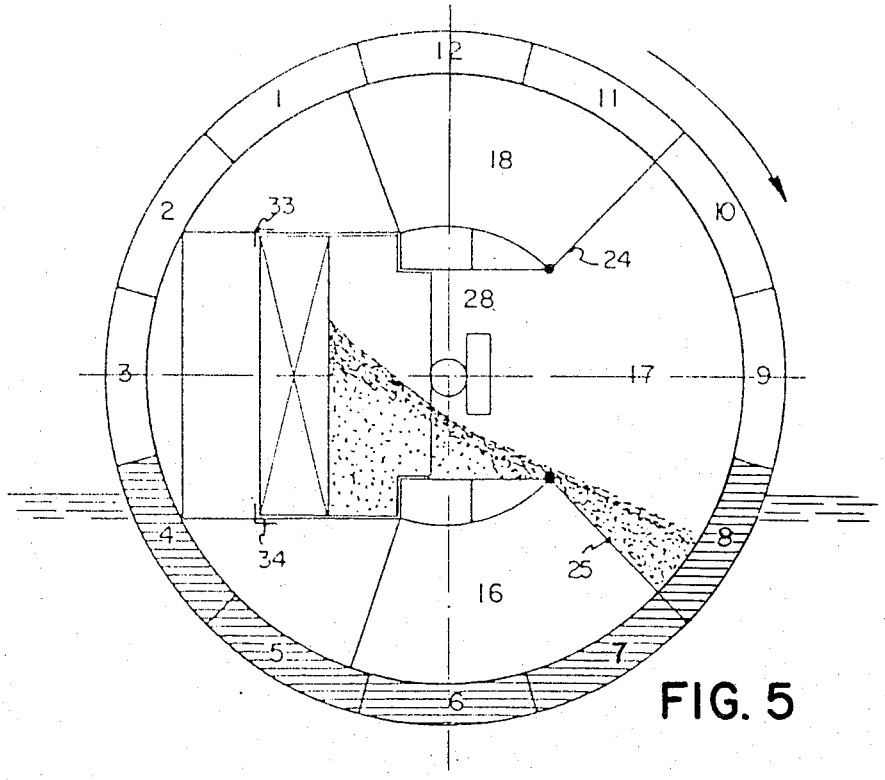
FIGS. 5 and 6 are still similar sections showing discharge of the load.

As the pontoon rotation begins, the load starts flowing through the vessel hatch to gallery 28 and then to the storage compartment 17 (FIG. 5).

Figure 6:
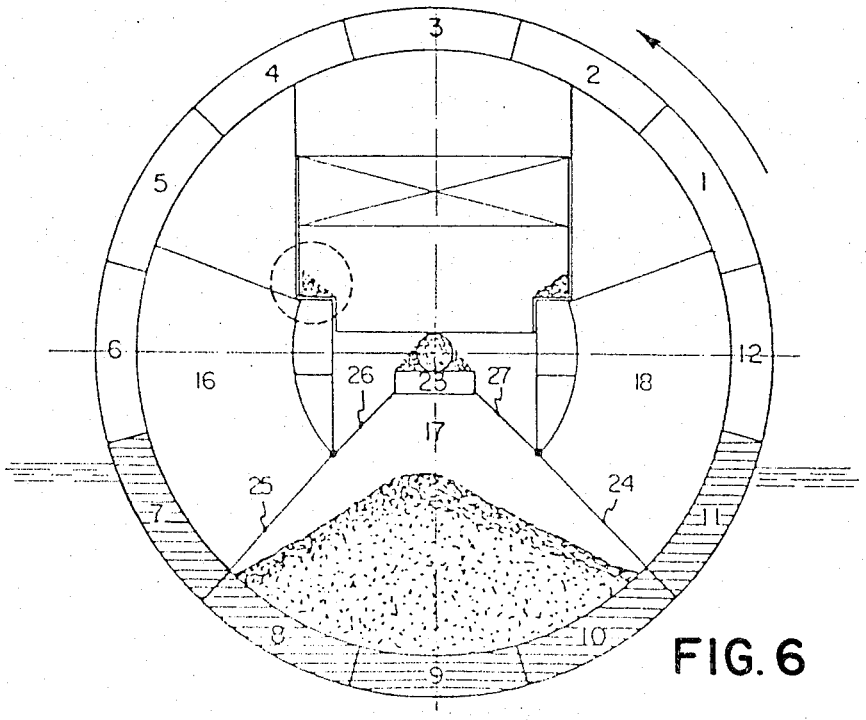

Continuing the rotation, the pontoon will accomplish a 180° turn when tanks 7, 8, 9, 10 and 11 are flooded (FIG. 6).

In this position, the pontoon is capsized and the load enters the storage compartment 17 due to gravity.

Finishing this operation, the discharge gallery 28 is shut by positioning 26 and 27 panels against the mechanical conveyor compartment (23), as shown in FIG. 6.

Now the pontoon is ready to return to its original position, which is achieved through water transference inside ballast tanks. The water transference is now done in inverse sequential order i.e., progressively from tanks 11 to 6; 10 to 5; 9 to 4; 8 to 3; 7 to 2; and 6 to 1.

Once the pontoon is in its normal upright position (FIG. 4), the hydraulic jacks (33 & 34) are lowered to the bottom of canal 19.

The flotation of vessel 21 is achieved simply by transferring water from tanks 2 & 4 to the lifting device (20), which will submerge to the canal bottom, releasing the vessel. After the removal of the horizontal adjusting jacks, the vessel can leave the apparatus.

Since the pontoon is in its upright position, load transference to outside can be achieved by means of any conventional mechanical conveyance (chain conveyor, endless screw, belt conveyor, etc.) or by their combination. The transportation system is installed inside a discharge chute (28). In upright position the chute is at the bottom of storage compartment (17); thus, under the load to be conveyed outside.

Concerning the cargo destination, there are two alternatives to accomplish the pontoon operation:

(a) the load must be transferred right away out of the pontoon, or temporarily kept in compartment 17;

(b) the load must be stored in one of the pontoon lateral storage compartments.

Considering the former case, the retractible panels (24 & 25) should have been closed at the beginning of the operation, in order to hinder the passage of load to compartments 16 and 18.

In the latter case, one or both panels should have been kept open at the beginning of the operation, in order to guide the load to its destined compartments (16 or 18), when the pontoon returning to its original position is performed.

If the load must be stored in compartment 16, the pontoon turning should be achieved as stated above, but, if the load is to be stored in comparment 18, the pontoon returning to its normal position must be carried out by continuating rotation in the same sense, accomplishing a 360° turn. The full turning of the pontoon is attained by progressively transferring water from tanks 7 to 12, 8 to 1, 9 to 2, 10 to 3, 11 to 4, 12 to 5 (FIG. 6).

When the load stored in lateral compartments (16 or 18), has to be conveyed outside, it must, as a first step, be transferred to compartment 17. This is done through the removal of the corresponding panel (24 or 25), and through an appropriate rotation of the pontoon.

The transshipment method described in this text suits best to unpowered vessels with no masts (barges), but it can also be employed to powered vessels since they are conveniently fitted.

Even the barges should submit to a structure overhaul, in order to check the structural resistance to overturning efforts, and, if necessary, provide the framing with reinforcement.

6. OPERATION WITHOUT LIFTING DEVICE

To raise and sustain within the pontoon the vessel to be unloaded (or repaired), hydraulic jacks can be used as shown by numerals 33 & 34 (FIG. 4), since they are properly constructed to bear the load. For this reason, the lifting device 20 in FIGS. 3 & 4 need not be used. The water transference from one tank to another—in order to cause rotation—must then be altered.

7. COMPLEMENTARY PROCEEDINGS AND ACCESSORY EQUIPMENT

During the turning of the pontoon, the vessel is capsized and its load falls to the storage compartment 17 due to gravity. When it occurs, part of the load is retained inside the vessel holds, because of the corners formed in the intersection of its sides and deck (FIG. 6). There are many ways to remove the remaining load, since the hold is adapted to the employment of appropriate mechanical equipment.

Figure 9:
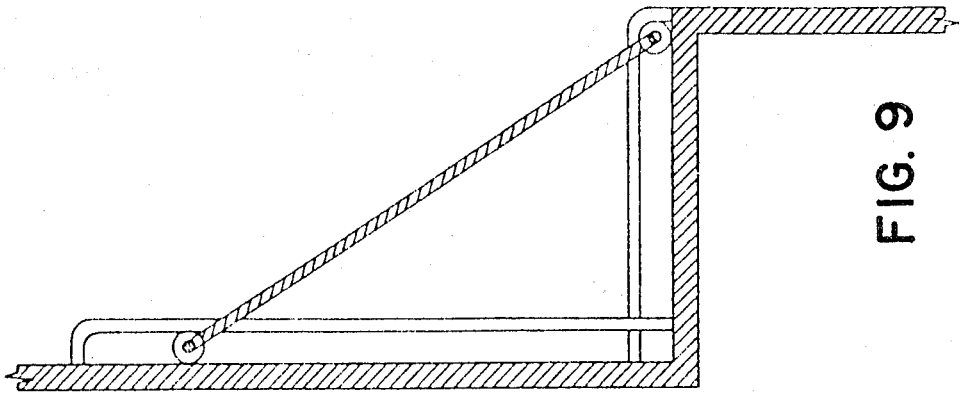
FIGS. 7, 8 and 9 illustrate the pusher panels used to remove the remaining load.
Figure 8:
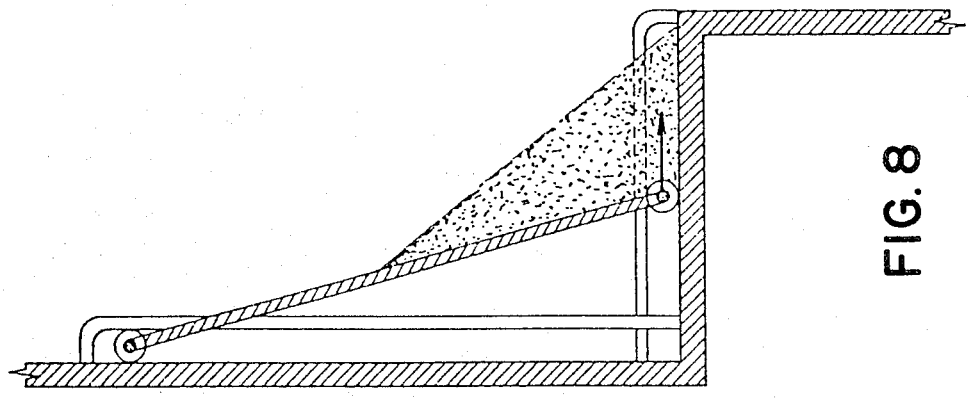
Figure 7:
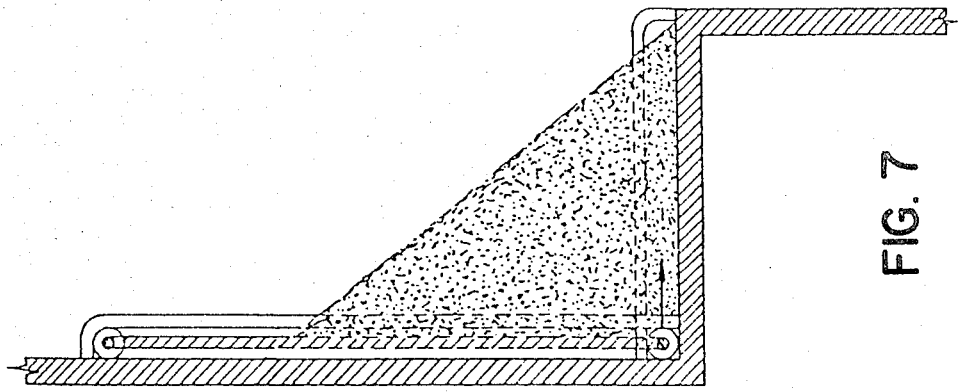

A good suggestion to this matter would be the installation of pusher panels (FIGS. 7, 8 & 9 which show, enlarged, a corner situated inside the dashed circle FIG. 6), juxtaposed to its walls in vertical position, when the vessel is floating (FIG. 7). After the capsizing, the panels can include (FIG. 8), moving their lower edges along the hatch face (FIG. 9), making all remaining load fall inside the compartment 17.

Panel movement can be achieved by hydraulic, mechanical, electromechanical or combined means, and its control should be preferentially remote, being capable to put all panels into motion simultaneously.

Figure 10:
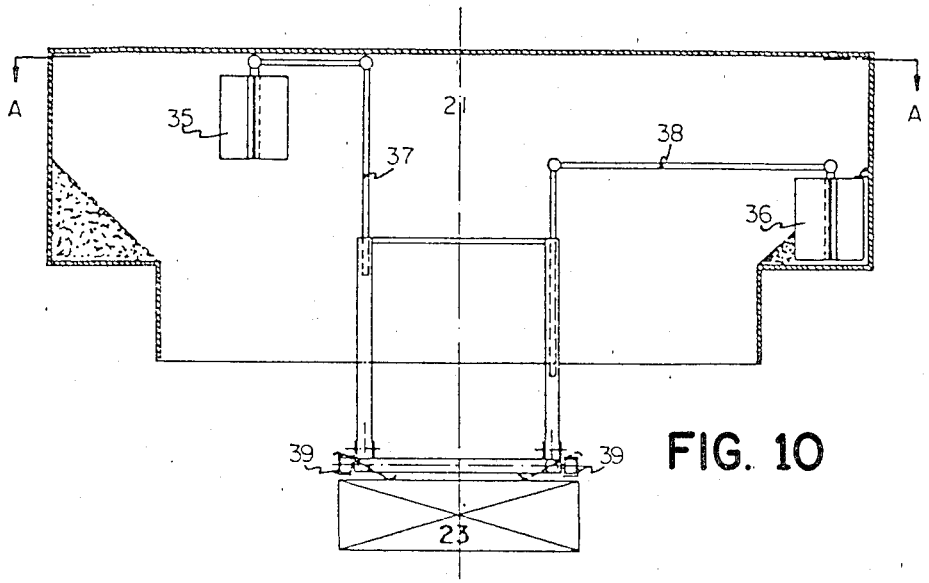
FIGS. 10 and 11 illustrate schematically the vaned rotor system.
Figure 11:
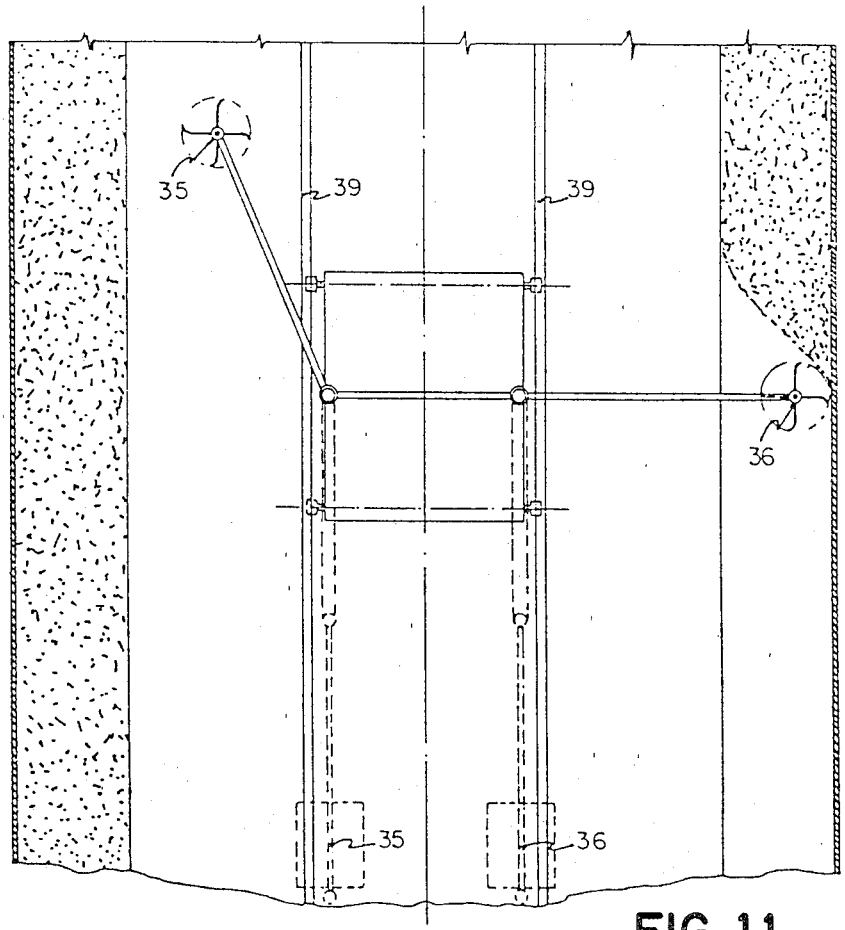

As accessory equipment, the Author conceived a vaned rotor system (35 & 36) indicated schematically in FIGS. 10 & 11, the former showing a transverse section of the vessel with its upper part undermost, and a section of the mechanical conveyor 23 as well as a side view of the equipment, the latter showing an internal top view of the pontoon.

The rotors are connected to a hinged arm system (37 & 38), which by its turn is attached by means of rails (39) to the bottom of the box containing the mechanical conveyor (23), allowing the equipment a longitudinal displacement.

The hinged arm system is hydraulically driven, enabling its positioning on the bottom of compartment 17 so that the vessel is allowed entrance inside the transshipment pontoon, when the equipment is not being used.

The same load removal procedure can be carried out with the rotors. The rotor blades can be swung one over the other, and all over the bottom of the compartment (hatched line—FIG. 11).

Figure 12:
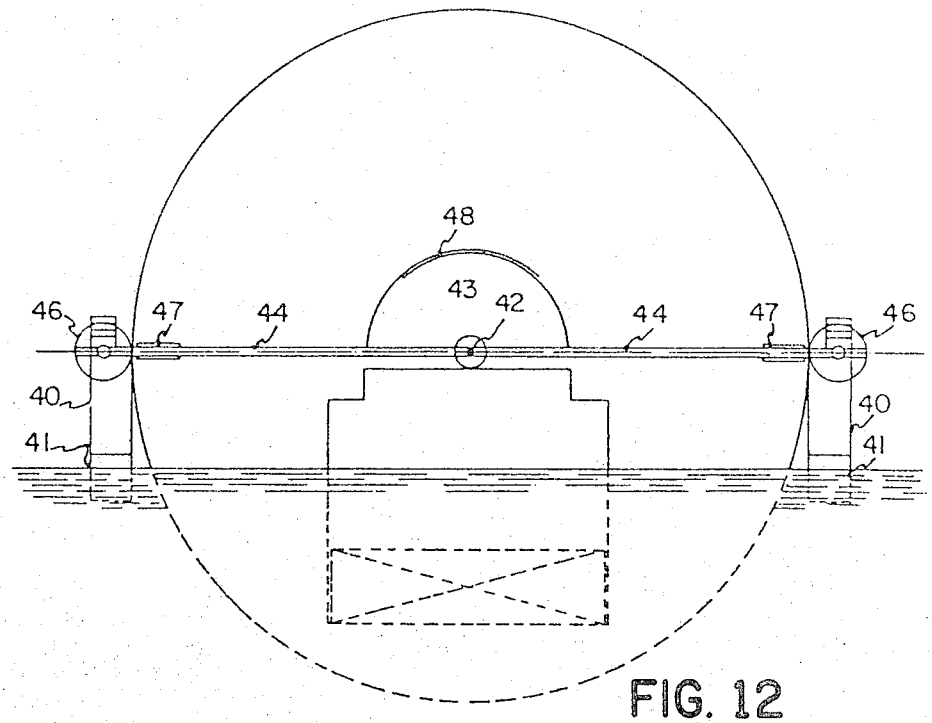
FIGS. 12, 13 and 14 show schematically respectively in cross section (FIGS. 12 and 13) and in general perspective (FIG. 14) the operational platform conceived by the Author.
Figure 13:
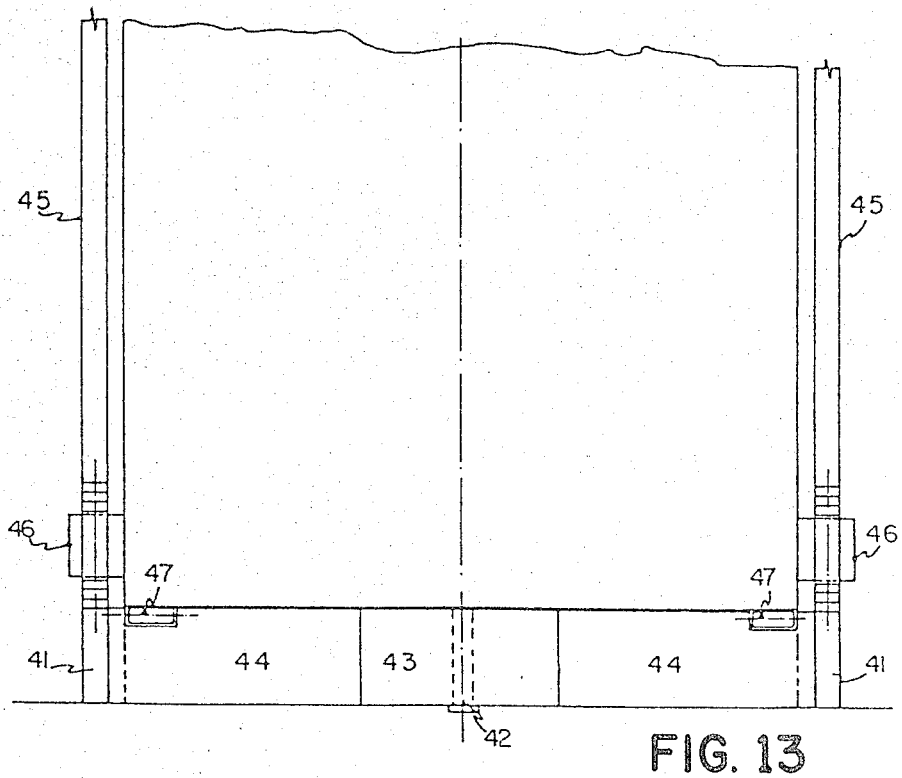
Figure 14:
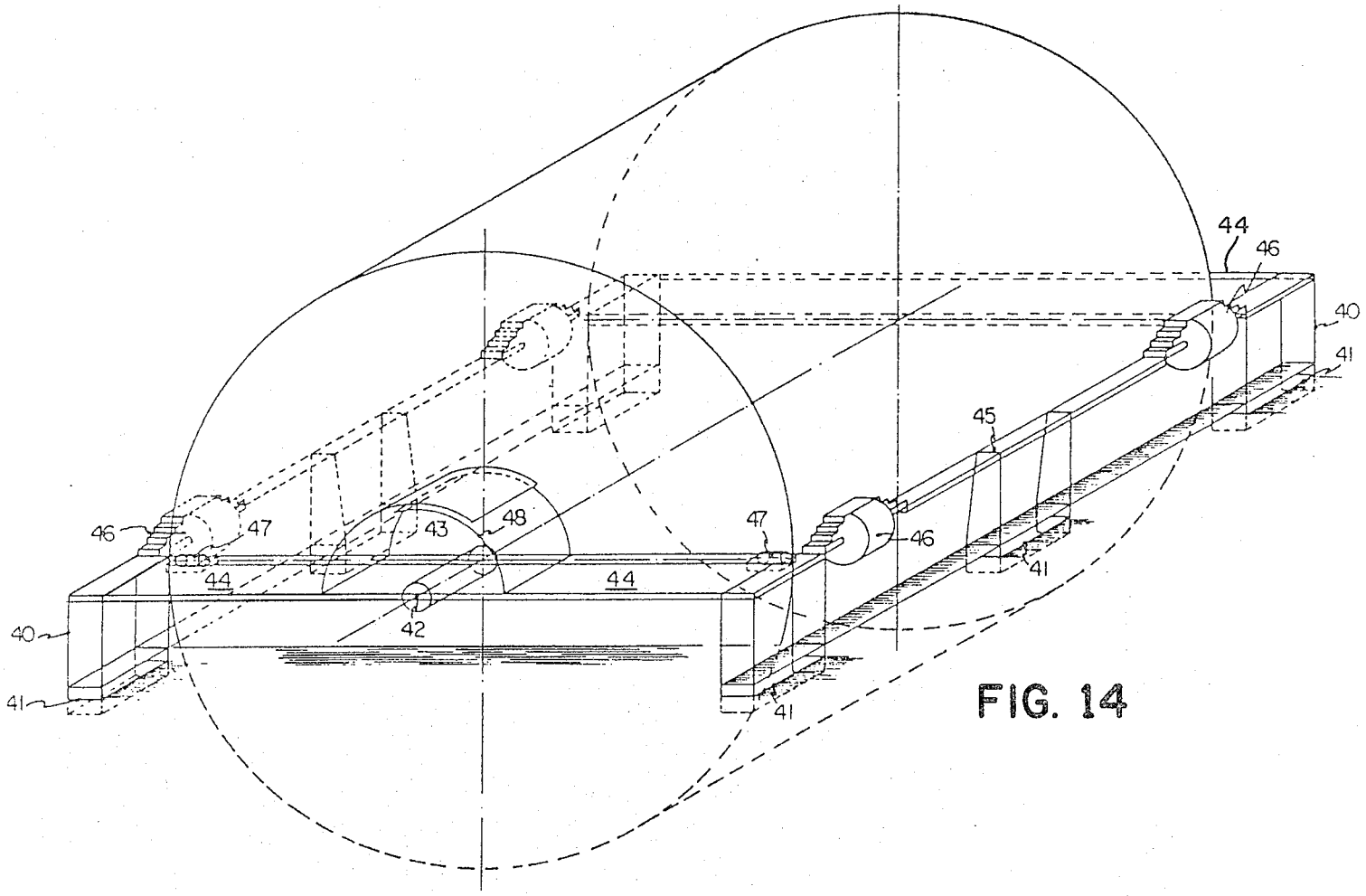

In order to place the tackles, reeving devices and fittings, achoring and raising implements (winches, anchors, anchor cables, rinding bitts, bitts, cleats, etc.) and also the engine room (with compressor, control board, etc.) the Author conceived the platform indicated in FIGS. 12, 13 & 14.

FIG. 12 shows a front view of the pontoon, FIG. 13 a top view and FIG. 14 a parallel perspective view.

This platform is held by columns (40), which are sustained by flotation tanks (41) of proper size to uphold not only its own weight but any weight or force exerted thereon.

This platform surrounds the transshipment pontoon and is attached to it through joints comprising hollow pins 42, placed along its longitudinal geometric axis.

The platform is divided in two equal parts that can support, one independently from the other, small movements produced by tensions on anchor cables, waves or other accidental overloads.

Each of these parts is made up of rigid sections interconnected through hinges to absorb the tensions previously mentioned.

On the transverse parts of the platform, situated at its ends (44), are placed the anchor cable winches and other pieces of the anchoring and raising implements. For this reason, these parts are exposed to higher tensions. Moreover, they should support also the efforts produced by the engine room (43) weight.

The platform side parts 45 are structural components designed to support principally the traction efforts resulting from tensions on the anchor cables, but they can also be used as passageways.

They contain the cylindrical fenders (46) designed to absorb the pontoon side shocks against other vessels or fixed structures (quay, pier, etc.).

These fenders also function as friction rollers during the pontoon rotation, when the whole platform stays in upright horizontal position.

The rollers (47) have identical function, serving to support the platform relative to the hull.

The engine room covering (48) has its transverse section in shape of concentrical circumference arcs, juxtaposed to allow independent movements of platform parts located on each side of hollow pins (42).

Since properly sized, the platform front parts, located at the pontoon entrance, can also function as a covering, so that hatches can be opened in rainy days.

Figure 15:
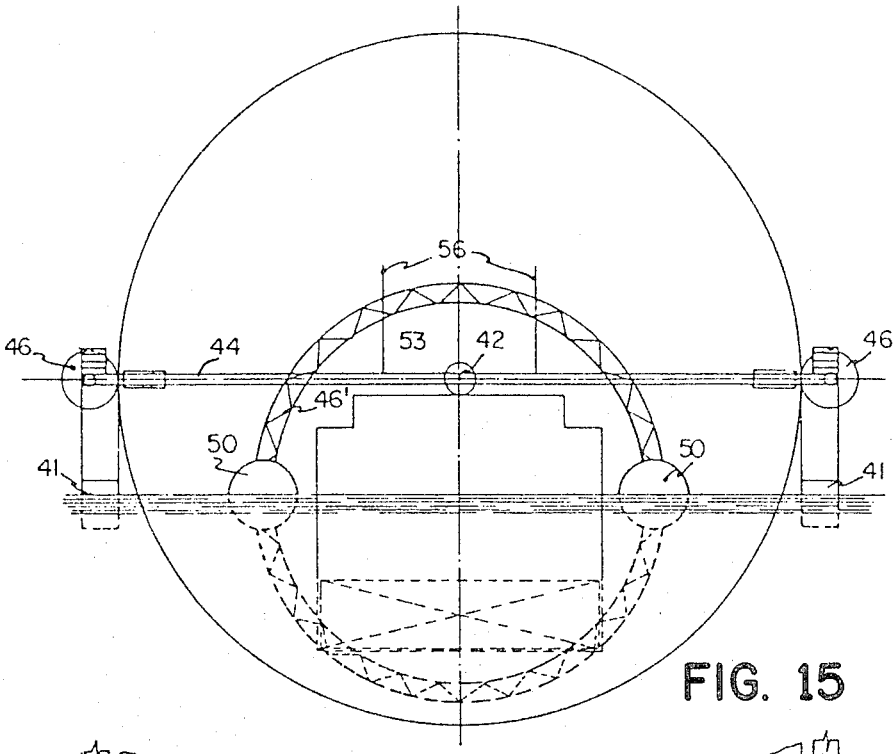
FIGS. 15 and 16 illustrate respectively a general sectional view and a detail of the special floating covering.
Figure 16:
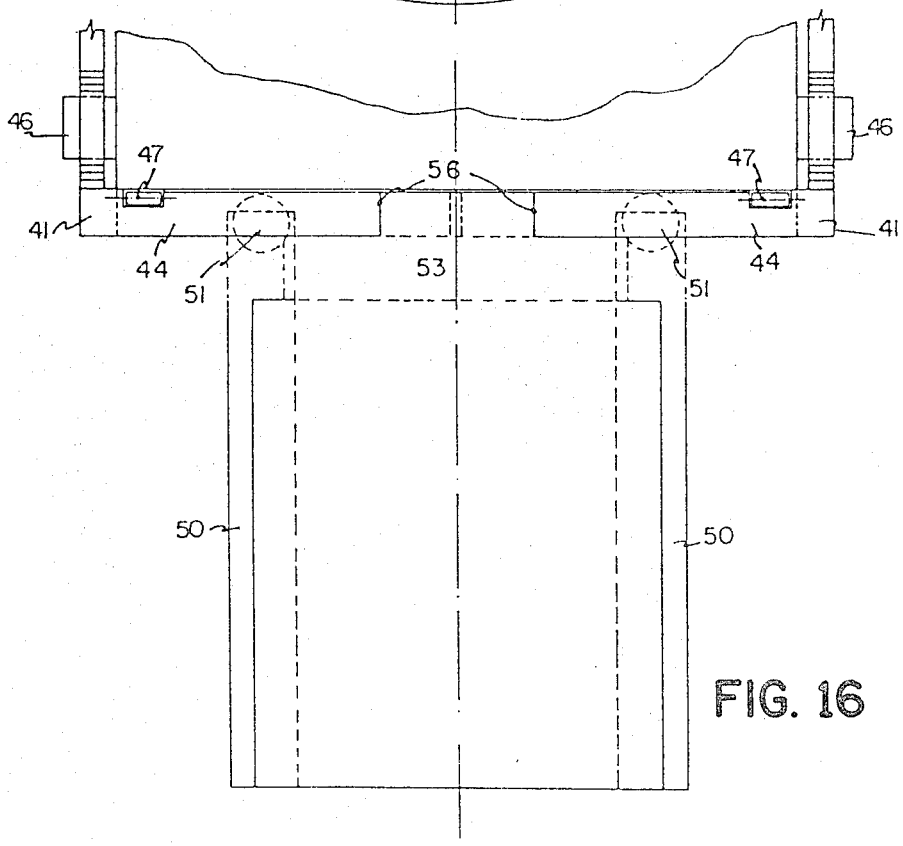

However, to reach this specific purpose, the Author conceived a special floating covering 46' (FIGS. 15 & 16) placed on a circular structure supported by longitudinal flotation tanks, resting against the pontoon hull by means of spheric fenders (51).

Figure 17:
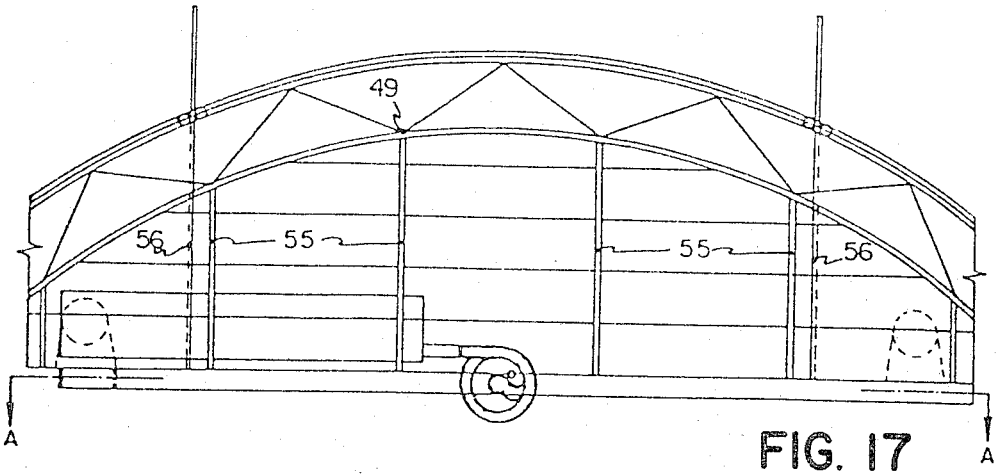
FIGS. 17, 18 and 19 represent the platform arrangement and the engine room respectively in enlarged partial front view (FIG. 17), plan or top view (FIG. 18), and horizontal section (FIG. 19)
Figure 18:
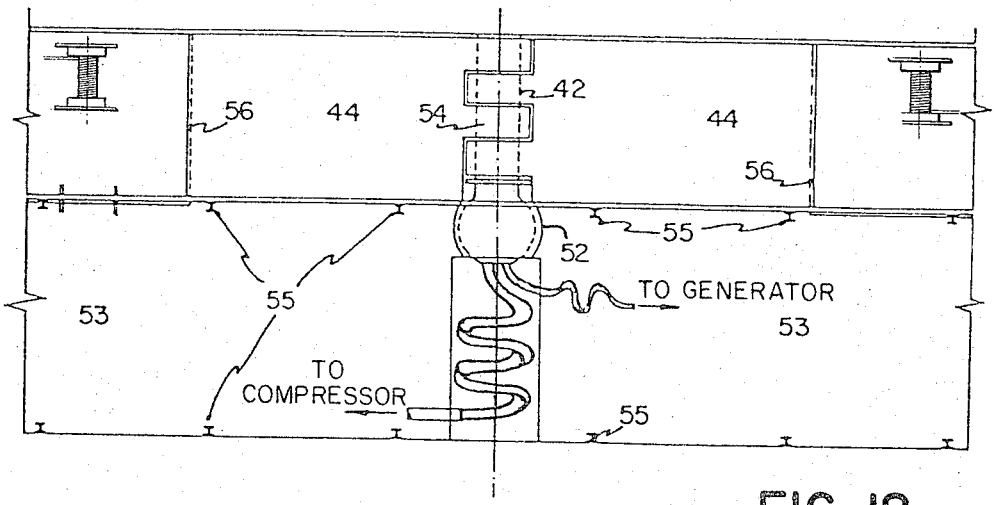
Figure 19:
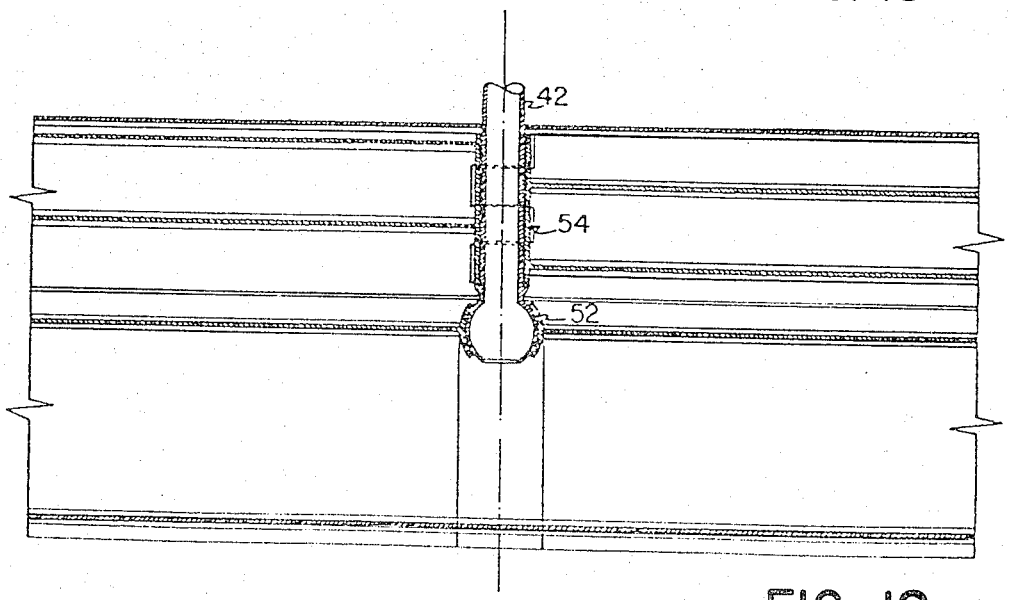

This structure, supported on pontoons 50, is attached to the pontoon through the same hollow pin 42 and also by means of a spherical articulation (52) independent from that one which connects platform 44, so that these two structures operate independently, as shown in FIGS. 17, 18 & 19 that represent, respectively, the platform (44) new arrangement and the engine room (53) enlarged partial front view, plan or top view and horizontal section.

In these drawings (FIGS. 17, 18 & 19) are shown the hinged articulation (54) from platform to pontoon and the spherical one (52) from floating covering to pontoon, both through the hollow pin (42) that is also used to lead canalizations and cables of general facilities (pneumatic, electric, hydraulic, etc.) inside the pontoon.

These canalizations and ducts, at least outside the hollow pin (42), must be flexible enough to support, without rupture, the pontoon rotation.

For this reason, this rotation should not surpass 360° in the same turning sense.

In this arrangement, the engine room (53) is hanged by the roof from (49) through guy rods 55.

The floating roof must have a fluctuating central part, covering the platform area (44), limited by panels (56). These panels are inserted in the roof fluctuating part, in order to enable independent movement of roof and platform without rupture.

To avoid abrupt rotations of the pontoon, it is possible to fit the fenders 46 (FIGS. 12 to 16) with a hydraulic brake system, which arrests motion by compressing the fenders against the hull. In that case, this extra-effort must be taken into consideration when dimensioning the flotation tanks 41 (FIGS. 12 to 16).

To achieve the external accessory equipment installation, and especially to provide the rotation braking, the belt device described in item No. 6 can also be used.

The solutions described in this text concerning equipment installation of the pontoon, if appropriate, can also be applied to any kind of floating dock.

INDUSTRIAL APPLICABILITY

Industrial applicability of present invention is obvious.

Any conventional method (manual, mechanical, hydraulic, etc.) can be used to control and set accessory equipment in motion. Automatic control from a point outside the system must be used when possible.

The design, dimensions and details of necessary equipment or contrivance, employed to perform the general operation of the rotating pontoon, as well as its accessories, must be achieved considering its purpose and local depth of water, whichever rotation method chosen. It concerns the designer or the shipyard which will apply the invention.

I claim:

1. A rotatable hollow cylindrical pontoon partially filled with liquid and capable of turning about its longitudinal axis at any desirable angle, said pontoon permitting maintenance and repair of a vessel being unloaded without the necessity of conventional dry-docking and adaptable to unload dry bulk vessels by gravity and to store dry bulk cargo, said pontoon including therein a watertight floating device to provide support for vessels to be processed, means for rotating said hollow cylindrical pontoon, said means comprising a plurality of separate ballast tanks, some of said tanks containing liquid; compressed air means for transferring liquid from selected ones of said liquid containing tanks to selected other non-liquid containing tanks whereby displacement of said liquid from one tank to another tank causes said pontoon to rotate by displacement of the center of gravity thereof.

2. A rotating pontoon according to claim 1 including, a discharge hopper within the pontoon adapted to receive the load discharged from a vessel within the pontoon, said vessel including a hold having corners therein.

3. A rotating pontoon according to claim 2 comprising, a load removal system for removing the portion of the load which remains next to the hold corners after the vessel is capsized, said system comprising vaned rotors attached to hinged arms that can be moved in order to place the rotors at any convenient work position and when the system ceases operation, both rotors can be placed in a single plane.

4. A rotating pontoon according to claim 1 including, a platform, said platform defining a rectangle within which said pontoon rotates, said platform attached to said pontoon by means of hollow cylindrical pins located at either end of the longitudinal geometric axis of said pontoon, flotation tanks connected to the platform for supporting it, said platform comprising articulated sections, an accessory enclosure comprising a transverse structure including a roof, said transverse structure located at the entrance of said pontoon, additional flotation tanks supporting said transverse structure, said transverse structure attached to said pontoon by means of a spherical joint.

5. A rotatable hollow cylindrical pontoon partially filled with liquid and capable of turning about its longitudinal axis, at any desirable angle, said pontoon including a hull and permitting maintenance and repair of a vessel being unloaded without the necessity of conventional dry-docking, said pontoon adaptable to unload dry bulk vessels by gravity and to store dry bulk cargo, said pontoon including therein a watertight floating device to provide sustaining of vessels to be processed, characterized in that the rotatable movement of said pontoon is accomplished by a belt extending along the external contour of the pontoon hull and capable of being held in a fixed position relative to the pontoon while said hull rotates, said belt permitting rotatable movement and braking of said hull, said belt comprising two cables extending along the pontoon hull, pulleys guiding said cables, said hull including trolleys connected to said belt for supporting implements to anchor and control the pontoon, means for braking the rotation movement of said pontoon and flotation tanks for anchoring said belt.

6. A rotating pontoon according to claim 5, including a rack and pinion gear system characterized by providing pontoon rotation and braking action by means of said pinion engaging said rack, said rack surrounding the pontoon, an engine producing said rotation and the braking being produced through the pinion in such a manner that the force resulting from the pinion on the rack is transmitted by the belt to the flotation tanks to which it is attached.

7. A rotatable hollow cylindrical pontoon partially filled with liquid and capable of turning about its longitudinal axis at any desirable angle, said pontoon including a hull and permitting maintenance and repair of a vessel being unloaded without the necessity of conventional dry-docking and adaptable to unload dry bulk vessels by gravity and store dry bulk cargo, said pontoon including therein a watertight floating device to provide support for vessels to be processed, and including means for rotating said hollow cylindrical pontoon, said means for rotating said pontoon comprising a plurality of separate, latitudinally arranged ballast tanks, said ballast tanks comprising continuous ring shaped compartments each including a watertight bulkhead dividing said compartments into two sections, air tubes adjacent to and on each side of said bulkhead connecting one section of each compartment to the other section thereof, each side of said bulkhead provided with valve controlled means communicating with compressed air means thereby permitting compressed air to be selectively introduced into one section or the other to displace the liquid ballast therein causing rotation of said pontoon about its longitudinal axis.

* * * * *